US008381877B1

(12) United States Patent
Freund

(10) Patent No.: US 8,381,877 B1
(45) Date of Patent: Feb. 26, 2013

(54) MODULAR LADDER

(76) Inventor: Paul E. Freund, Loveland, OH (US)

( * ) Notice: Subject to any disclaimer, the term of this patent is extended or adjusted under 35 U.S.C. 154(b) by 189 days.

(21) Appl. No.: 12/804,654

(22) Filed: Jul. 28, 2010

(51) Int. Cl.
*E06C 1/10* (2006.01)

(52) U.S. Cl. ..... 182/194; 182/116

(58) Field of Classification Search ..... 182/194, 182/116, 178.2, 178.3, 151, 93
See application file for complete search history.

(56) References Cited

U.S. PATENT DOCUMENTS 1,466,757 A * 9/1923 Riemer ..... 182/116
1,589,655 A * 6/1926 Nelson ..... 182/169
2,718,346 A * 9/1955 Galen ..... 182/104
4,991,690 A * 2/1991 Woller ..... 182/93
6,053,278 A * 4/2000 Myers ..... 182/20
2005/0092548 A1* 5/2005 Sullivan, Jr. ..... 182/151
2008/0128204 A1* 6/2008 Engstrom ..... 182/116

* cited by examiner

*Primary Examiner* — Katherine Mitchell
*Assistant Examiner* — Kristine Florio
(74) *Attorney, Agent, or Firm* — Neal O. Willmann

(57) ABSTRACT

Disclosed herein is a ladder assembly consisting of a plurality of ladder segments each comprising a pair of identical rails, a third rail disposed medially between the parallel rails but not in the same plane, a plurality of rungs forming steps perpendicularly positioned and attached to the parallel rails but each diverted medially to attach to the third rail, and a plurality of joints sized to join each segment end-on-end to form the assembly, but with the proviso that in any ladder assembly having at least three segments, one of the third rails in the assembly is shorter than the other rails.

8 Claims, 7 Drawing Sheets

MODULAR LADDER

BACKGROUND OF THE INVENTION

This invention relates to ladders. In particular, it relates to a ladder assembly formed from a plurality of ladder segments. The ladder segments are easy to carry, convenient to store, and simple to connect to construct the ladder assembly desired. These features appeal to outdoorsmen who desire to transport an elevating structure into the field for hunting and observation purposes. More specifically, the disclosed ladder segments feature a third rail that imparts extraordinary strength and stability to each segment and, ultimately, to the ladder assembly. Ladder segments having enhanced strength and stability can be constructed of lighter weight materials, and lighter weight ladder segments inherently have greater portability and utility in the field.

DESCRIPTION OF THE PRIOR ART

The patent art relating to ladders is legion. There is no shortage of features and designs that have been brought to the ladder art for the purpose of increasing the utility and practicality of all manner of ladders for certain and various uses. Clearly, all ladders need to be safe and sturdy. Most ladders need to be lightweight and easy to handle. More ladders would benefit by being segmented to make them easier to transport and store. The disclosed ladder assembly is lightweight and strong, segmented and easy to carry and store, and extraordinarily stable for use in the field. Nothing in the prior art suggests or approximates the features of the instantly disclosed ladder assembly.

SUMMARY OF THE INVENTION

Essentially, the ladder assembly disclosed herein consists of a plurality of ladder segments. Each segment comprises a pair of identical parallel rails equal in predetermined length and having a pair of top and bottom ends. Each segment has a third rail having a predetermined length equal to that of the parallel rails, but it is not positioned in the same plane as the parallel rails. Each ladder segment has a plurality of rungs forming steps appropriately positioned and attached perpendicularly to the parallel rails, and each rung is diverted medially to attach to the third rail. Each ladder segment has, or can accommodate, a plurality of joints sized to receive the ends of the rails to facilitate joining one ladder segment to another end-to-end to form a ladder assembly, but with the proviso that in any ladder assembly having at least three segments, one of said third rails in the assembly is shorter than all other rails.

In a preferred embodiment of the disclosed ladder assembly having at least three segments, the parallel rails in the segment having the shorter third rail are flared or diverted away from the center of the ladder at one end of the segment. The flaring is designed and intended to increase the stability of the ladder assembly. The ladder assembly segment having the flared ends and shorter third rail will typically be the bottom segment in the assembly. In an even more preferred embodiment of the disclosed ladder assembly, there is a means for attaching and/or securing the ladder assembly to a structure, said structure frequently being a tree, and the attaching means will frequently be positioned on the top segment of the ladder assembly.

In an embodiment of the disclosed ladder assembly specifically intended for use in the field for purposes of positioning hunters in elevated positions, the ladder assembly will be further fitted with a platform and seat assembly.

DETAILED DESCRIPTION OF THE INVENTION

Figure 1:
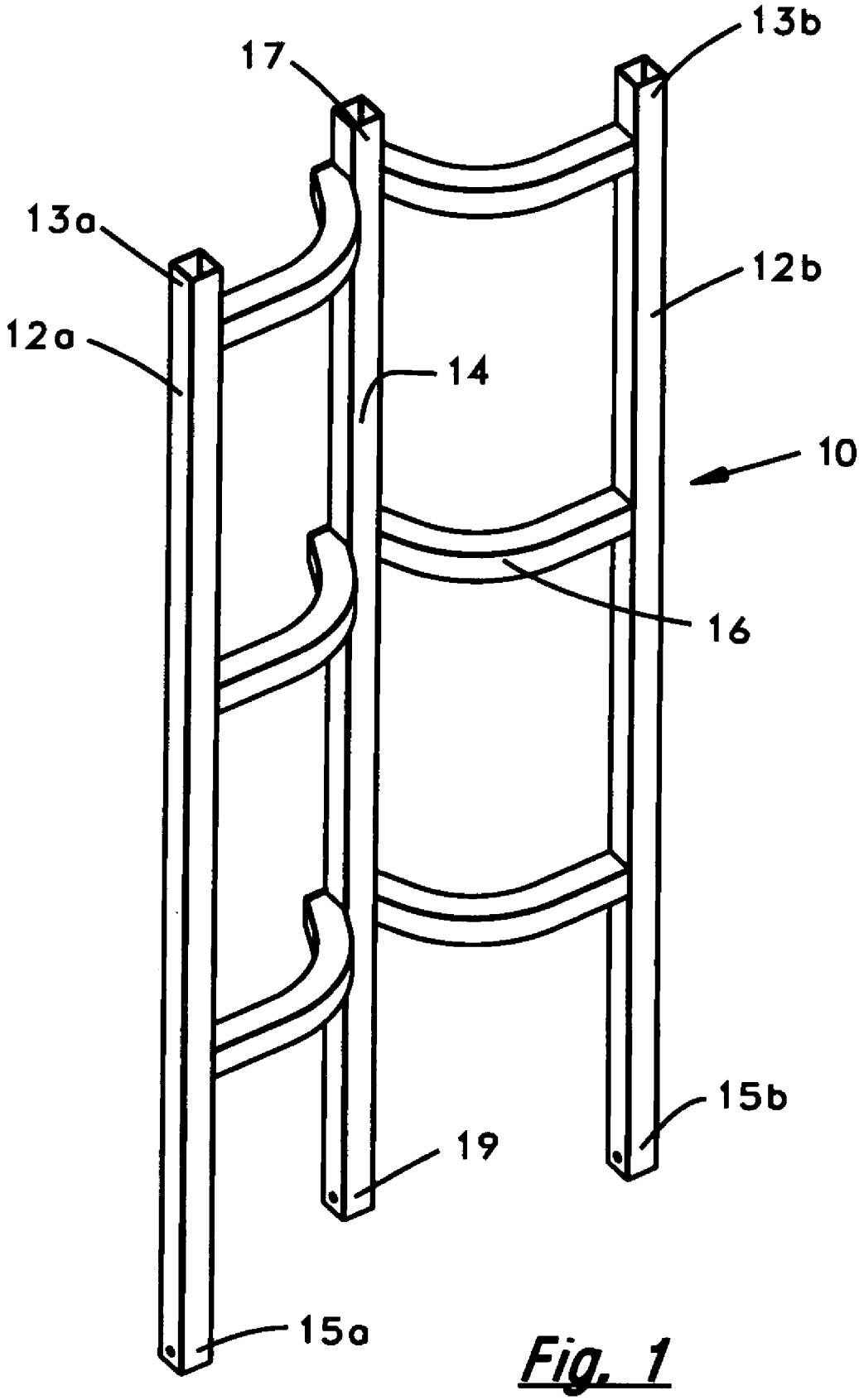
FIG. 1 is an illustration of a segment of the disclosed ladder assembly.
Figure 5:
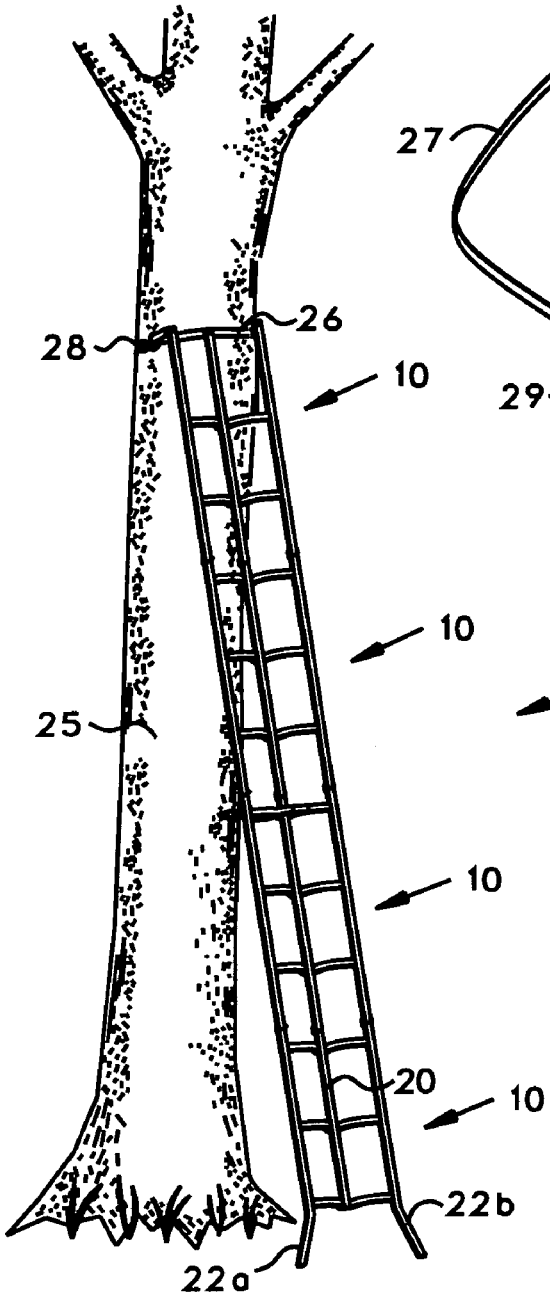
FIG. 5 illustrates a ladder assembly adjustably attached to a structure and wherein one of the segments has flared rails.

Understanding and appreciation of the disclosed ladder assembly are best obtained by frequent reference to the drawing. FIG. 1 illustrates a segment 10 of the ladder assembly 30, which consists of a plurality of segments (FIG. 5). Each segment 10 comprises a pair of identical parallel rails 12*a* and 12*b*. "Identical" means, of course, that the rails are interchangeable and of equal length, which is predetermined by each rail having an upper 13*a*, 13*b* and lower ends 15*a*, 15*b*. Each segment 10 also has a third rail 14 having top 17 and bottom 19 ends defining a predetermined length equal to the parallel rails 12*a*, 12*b* and disposed medially between the parallel rails, but not in the same plane as the parallel rails. As with all or most ladders, the segments 10 of the disclosed ladder assembly 30 have a plurality of rungs 16, which are appropriately positioned between the parallel rails 12*a* and 12*b* and attached perpendicularly to them. Furthermore, each rung 16 is diverted medially to engage and attach to the third rail 14.

To provide for the assemblage of the disclosed ladder assembly 30, each segment 10 further includes or can accommodate a plurality of joints (FIG. 7), which are sized to receive the ends 13*a*, 13*b*, 15*a*, 15*b*, 17 and 19 of the rails so as to join one ladder segment 10 to one or more other segments, end-to-end.

Figure 4:
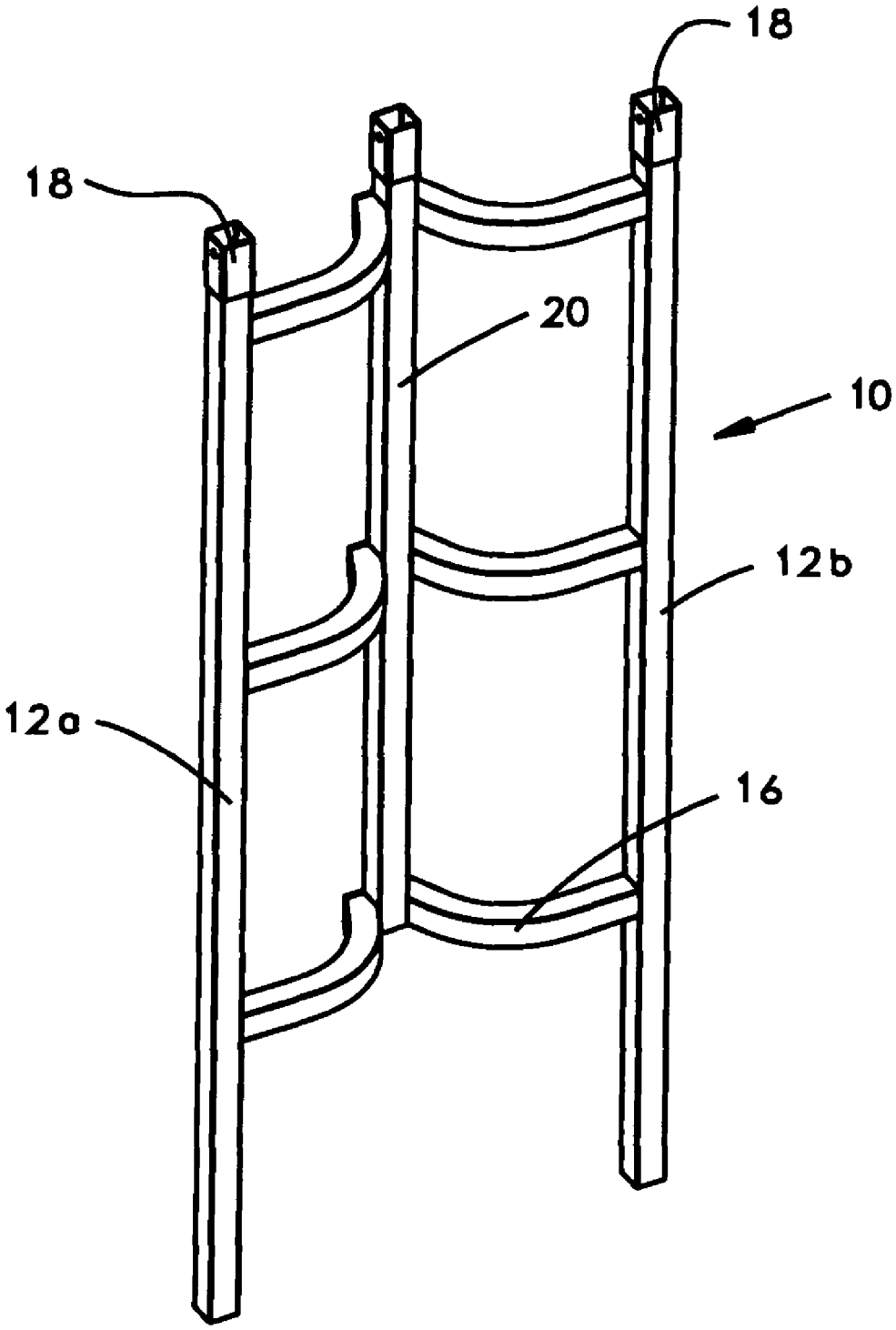
FIG. 4 illustrates a segment of the ladder assembly having three or more segments in which the third rail is shorter than the other rails.

In instances where the ladder assembly 30 consists of at least three segments 10, one of the third rails 20 is necessarily shorter than the others (FIG. 4). Typically, the segment 10 with the shorter third rail 20 is the bottom or lowest of the three segments when the ladder assembly 30 is deployed for use. The shorter third rail 20 eliminates the possibility of interference with the ground as the distance of the bottom of the ladder from the support structure 25 is increased.

Figure 2:
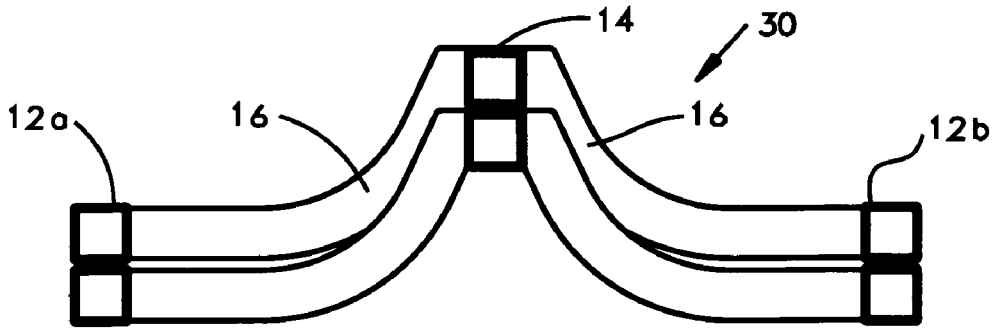
FIG. 2 is an end view depicting the nesting capability of the segments of the ladder assembly.
Figure 3:
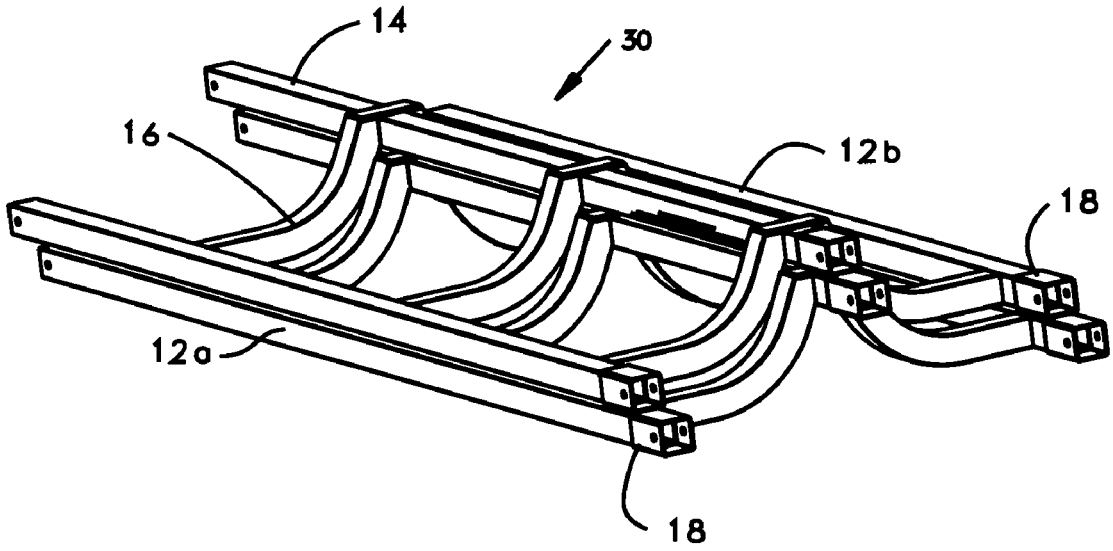
FIG. 3 is a perspective view of the nested ladder segments of FIG. 2.

As mentioned, the disclosed ladder assembly 30 is easily stored and easily transportable. The segments 10 of the assembly 30 are conveniently stored by simply stacking one segment 10 on top of another (FIGS. 2 and 3). The third dimension of the ladder segments 10, which results from the third rail 14, 20 positioned in a plane different from the parallel rails 12*a*, 12*b* enables and is conducive to the ladder segments being not only stackable but nestable. And because of the enhanced structural strength provided by the third rail 14, the segments 10 need not be over-engineered with strength and weight-enhancing features. The added structural strength also eliminates the need for additional support members or braces from the middle segments of the ladder assembly 30 to the support structure 25 as with typical modular ladder assemblies. Therefore, a plurality of segments can be stacked, one on top of the other, and still be light enough to carry into the field.

In the field, the segments 10 are assembled, end-on-end, to form the ladder assembly 30 (FIG. 5). Experimentation with the ladder assembly in the field suggests that added stability can be added to the assembly by flaring the parallel rails 22*a* and 22*b* of the segment equipped with the shorter third rail 20. By flaring the parallel rails, the segment, typically the lower segment in the ladder assembly, will have a wider base stance and impart more stability to the assembly 30. The flaring can easily be accomplished by bending the tubing forming the rails 22*a* and 22*b* away from the center of the ladder in the plane formed by the two rails. Additional attachments can be added to the flared ends such as adjustable leveling feet to allow for the ladder to be positioned on an uneven surface.

Figure 6:
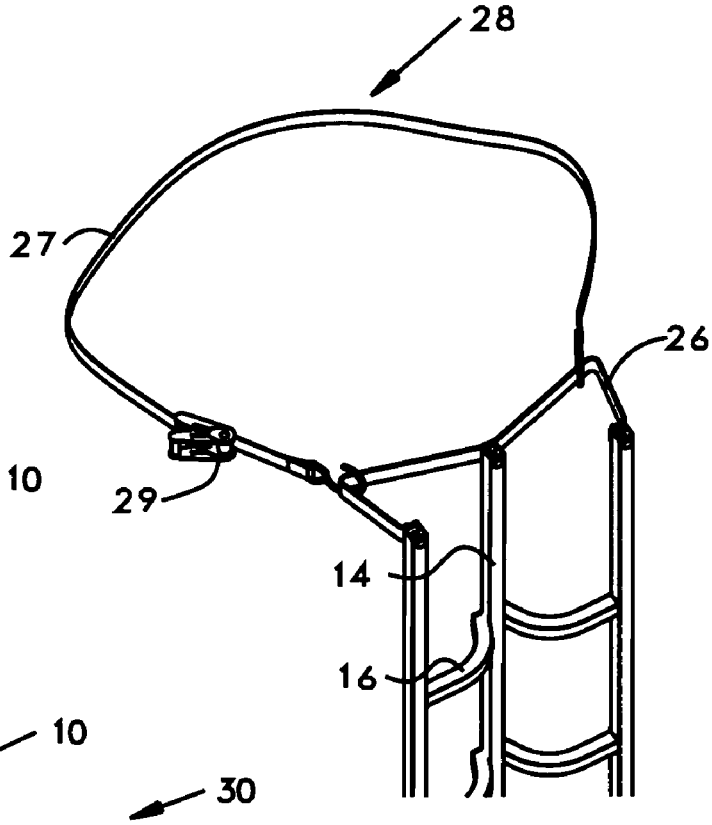
FIG. 6 is an isolated view of an attaching means for stabilizing the ladder assembly against a structure.

Stability of the ladder assembly in the field can also be enhanced by adjustably attaching the assembly to a structure 25, typically a tree. Therefore an attachment means 28 is illustrated in FIG. 6. A suitable attachment means need be little more than a flexible strap 27 with an integrated tensioning means 29 to adjust the flexible strap to the structure 25. The attachment means 28 can be attached directly to one of the segments of the ladder assembly or an intermediary bracket device 26. Typically, any attachment means will be most effective at stabilizing the assembly if it interacts with the upper-most segment in the assembly. FIG. 5 depicts a fully extended ladder assembly securely attached to tree by an attachment means 28 and further stabilized with flared rails 22*a* and 22*b* on the lowermost segment.

Figure 7:
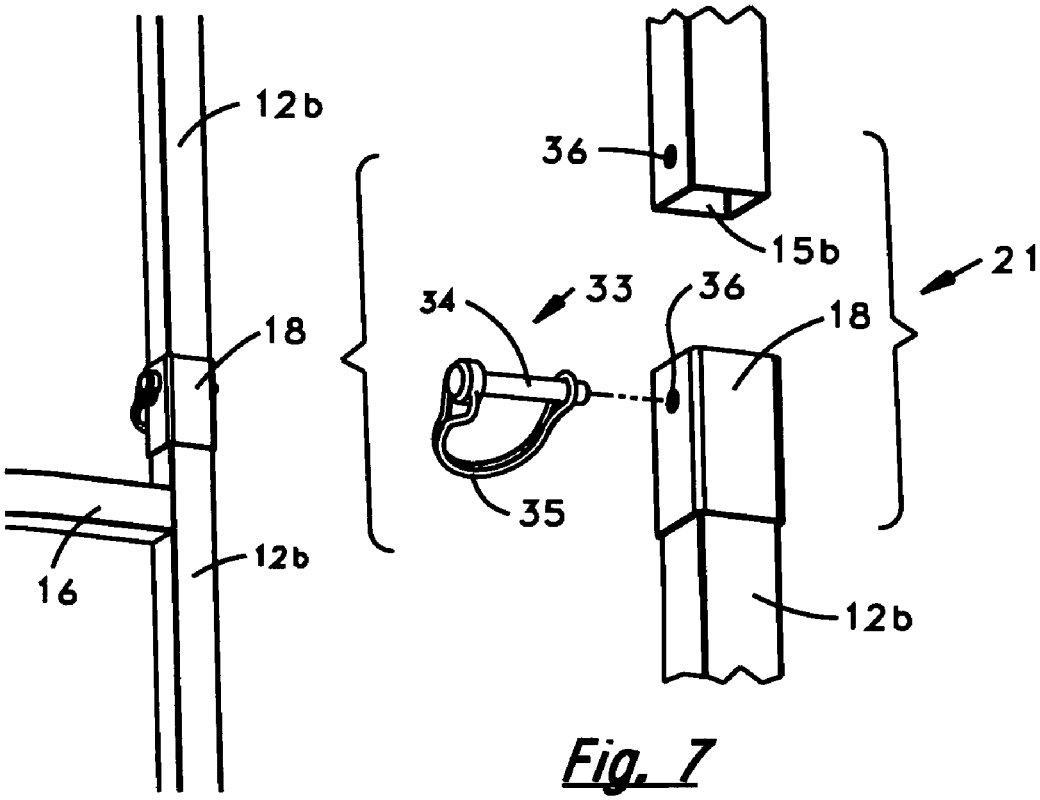
FIG. 7 is an isolated view of one of the plurality of joints sized to receive the ends of the rails to join the segments end-to-end.

With further regard to constructing the ladder assembly 30 from a plurality of segments 10, FIG. 7 illustrates one possible type of joint assembly 21, including a joint 18 having a pin hole 36 for interacting with a safety retaining pin assembly 33 having a pin 34 and a spring retaining strap 35. The pin 34, pin hole 36 and spring retaining strap 35 combine to provide a means for securing each joint 18 to the juncture of the joined rails. The joint 18 is typically constructed from a short length of tubing sized to accommodate the tops and bottoms of parallel rails 12*a* and 12*b* and third or middle rails 14 and 20 and is permanently fixed to the top end of rails 12*a*, 12*b* and 14,20. In operation, the joint 18 joins the top 13*b* of parallel rail 12*b* to the bottom 15*b* of another parallel rail 12*b* and the juncture is secured by inserting pin 34 through aligned holes 36 (in the rails and joints), and wherein the pin 34 is retained in place by a spring retaining strap 35. The same joint and retaining pin assemblies 21 and 33 are employed in each instance where it is desirable or necessary to join one parallel rail 12*a*, 12*b* or third rail 14, 20 to another. The elements of the safety retaining pin assembly 33 are conventional hardware items and readily available.

Figure 8:
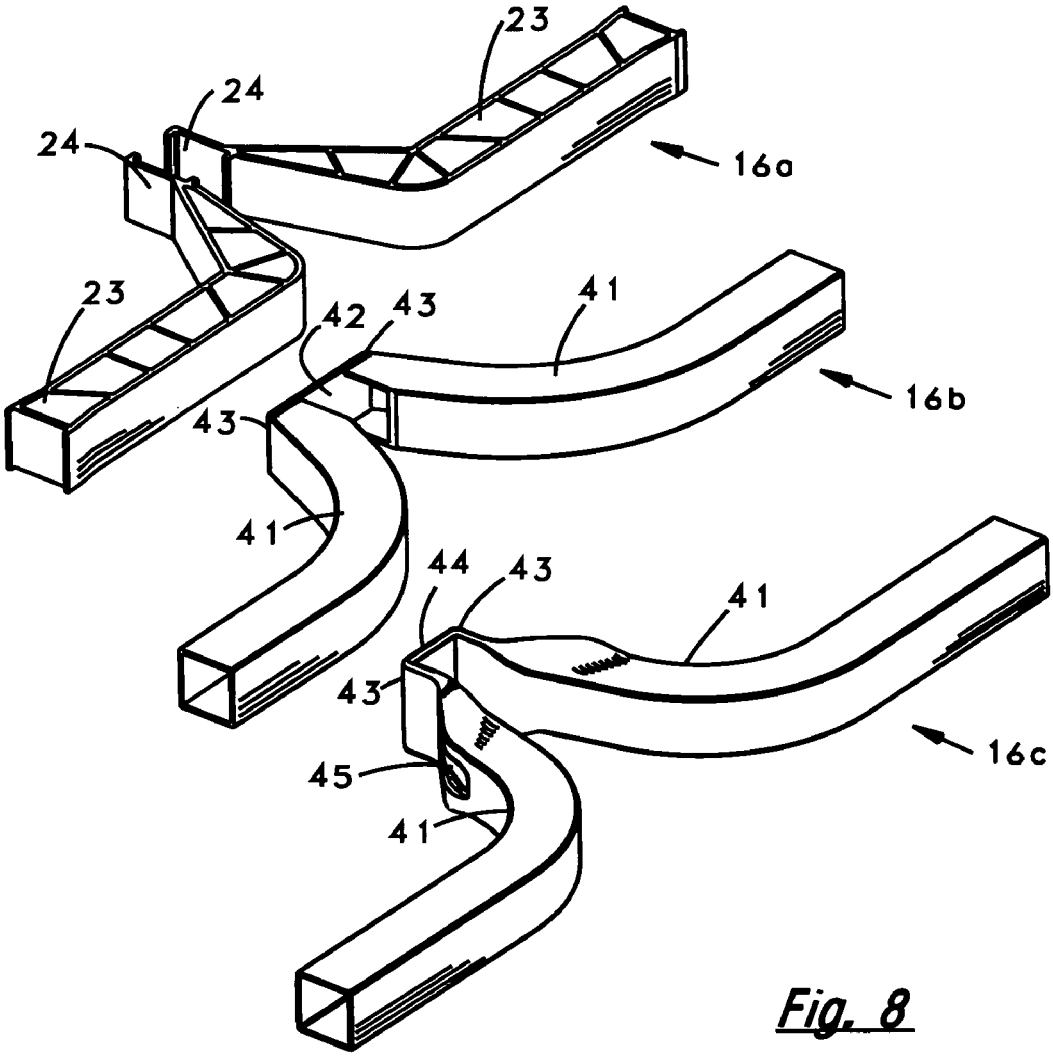
FIG. 8 is an enlarged view of several rung embodiments suitable for use in the disclosed ladder assembly.

Inherent in the third-rail design of the ladder assembly 30 disclosed herein, the ladder segments are connected at three points instead of the usual two points in the conventional ladder system. The three-point design greatly increases the stability of the assembly and reduces stress in the joint elements. Consequently, the joint assembly 21 utilized herein can be fabricated from smaller and lighter weight material. The third rail design also allows for many additional configurations for joining segments that would not be possible with conventional two rail modular ladder designs such as joints made from flexible materials to make assembly of the ladder sections 10 easier. Enlargements of the rungs 16 of the ladder segment 10 are depicted in FIG. 8.

While it should be apparent that a variety of rung designs and fabrications is suitable for deployment for use in the instantly disclosed ladder assembly 30, it should also be apparent that the rungs required in this assembly are unique. While clearly, like other ladders, the rungs are perpendicularly attached to each of the parallel rails 12*a* and 12*b*, but, unlike other ladders, it is essential that each rung is diverted medially from its perpendicular orientation for attachment to the third rail 14, 20 of the segment, which is disposed medially between the parallel rails but not in the same plane as the parallel rails. Hence, there are two dramatically unique features of the disclosed ladder segments: curved or diverted rungs and a third rail.

The configuration of the rungs diverting medially to the third rail dramatically increases the strength of the ladder segments and provides a configuration conducive for nesting the segments (FIG. 3) to facilitate storing and toting. And, compared to the traditional perpendicular rail and rung configuration, the span of the medially diverted rung is reduced. The shorter the rung-span, the less stress on the rung from the weight of the climber, and this permits a lighter weight design for the rung, which experimentation has shown, more than compensates for the additional weight of the third rail. FIG. 8 illustrates various designs 16*a*, 16*b*, and 16*c* that have demonstrated suitability in conforming to the form and function of the disclosed ladder assembly. An extruded or cast rung 16*a* is used in pairs for attachment to rails 12*a*, 12*b*, 14 and 20. These rungs include hollow cavities 23 for weight reduction and are designed with areas 24 that have partial profiles to match the corresponding profile of the outer rails 12*a*, 12*b* 14 and 20 which improves the strength of the assembly of the rungs attached to said rails. Furthermore, the extruded or cast rungs fabricated according to depiction 16*a* in FIG. 8 are installed in pairs consisting of elements easier to fabricate because of their reduced size.

Rung 16*b* is an example of a rung formed from a single piece of tubing 41, which has a section notched out of the tubing 42 sized appropriately to allow the rung to be bent at points 43 in a configuration that forms a profile to match the middle rail 14 and 20. And 16*c* illustrates a rung fabricating using bending and forming dies to create a rung from a single piece of tubing 41 which has been flattened in area 44 and is bent in areas 43 in a configuration to match the profile of the third rail 14 and 20. To facilitate the flattening of the tubing the forming dies may include features to form indentations in the tubing 45 to initiate collapse of the tubing during the forming process.

Figure 9:
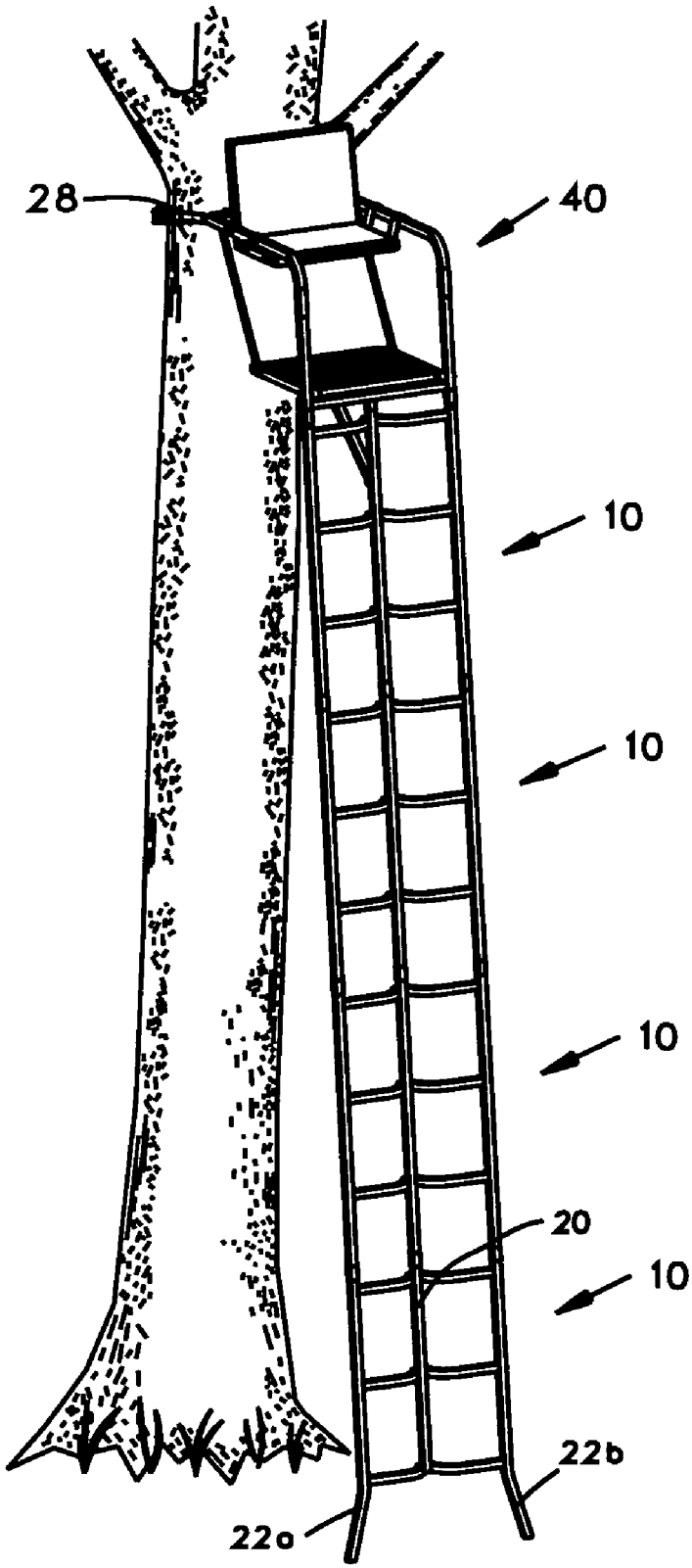
FIG. 9 depicts the ladder assembly fitted with a chair and platform for use in the field.

FIG. 9 illustrates the ultimate embodiment of the disclosed ladder assembly. In this depiction, the ladder segments 10 are joined end-on-end to form the assembly 30. The bottom segment features a shorter third rail 20 to provide suitable ground clearance, as well as flared rails 22*a* and 22*b* to enhance stability in the field. The ladder assembly also can accommodate a platform and seat assembly 40 attached to the top segment to provide a suitable resting means for the elevated observer in the field. Such platforms and seat assemblies are typical on observation stands and are easily configured for use with the three rail ladder assembly 30.

While the foregoing is a detailed and complete description of the preferred embodiments of the disclosed ladder, it should be apparent that numerous variations and modifications can be made and employed to implement the all-important purpose of the disclosed ladder without departing from the spirit of the invention, which is fairly defined by the appended claims.

The invention claimed is:

1. A ladder assembly consisting of a plurality of ladder segments each comprising:

a pair of identical parallel rails having top and bottom ends defining predetermined lengths;

a third rail having top and bottom ends defining a predetermined length equal to said parallel rails disposed medially between said parallel rails and parallel to said rails but not coplanar;

a plurality of rungs forming steps appropriately positioned and attached perpendicularly to said parallel rails and each rung diverted medially to attach to said third rail;

a plurality of joints sized to receive the ends of said rails for the purpose of joining one ladder segment to another; and with the proviso that in a ladder assembly having at least three segments, said third rail in the bottom segment of said assembly is shorter than all other rails.

2. The ladder assembly according to claim 1 wherein the parallel rails of the segment having the shorter third rail are flared at one end of said segment.

3. The ladder assembly according to claim 1 further including a means for attaching said ladder assembly to a structure.

4. The ladder assembly according to claim 3 wherein the attaching means is a flexible strap and tensioning device.

5. The ladder assembly according to claim 1 further including a seat platform and seat for attachment to the top end of one segment.

6. The ladder assembly according to claim 1 wherein each of said rungs comprises paired rung elements.

7. The ladder assembly according to claim 1 wherein each of said joints further includes a means for securing each joint to the juncture of said joined rails.

8. The ladder assembly according to claim 1 wherein the segments are nestable to facilitate storing and carrying.

* * * * *